US011111118B2

(12) United States Patent
Lim et al.

(10) Patent No.: US 11,111,118 B2
(45) Date of Patent: Sep. 7, 2021

(54) VEHICLE JACK DEVICE

(71) Applicants: LG CHEM, LTD., Seoul (KR); TAE JUNG TECHNICAL MFG CO., LTD., Chungju-si (KR)

(72) Inventors: Dong Kyu Lim, Daejeon (KR); Tai-Soo Shin, Chungju-si (KR); Sun Woo Kim, Daejeon (KR); Se Jung Lee, Daejeon (KR); Ji Eun Im, Daejeon (KR); Ilhwan Sa, Chungju-si (KR); Woosuk Choi, Chungju-si (KR); Ho Seon Park, Incheon (KR); Ku Hee Anh, Chungju-si (KR)

(73) Assignees: LG CHEM, LTD., Seoul (KR); TAE JUNG TECHNICAL MFG CO., LTD., Chungcheongbuk-Do (KR)

( * ) Notice: Subject to any disclaimer, the term of this patent is extended or adjusted under 35 U.S.C. 154(b) by 163 days.

(21) Appl. No.: 16/344,082

(22) PCT Filed: Nov. 20, 2017

(86) PCT No.: PCT/KR2017/013211
§ 371 (c)(1),
(2) Date: Apr. 23, 2019

(87) PCT Pub. No.: WO2018/139747
PCT Pub. Date: Aug. 2, 2018

(65) Prior Publication Data

US 2019/0241413 A1 Aug. 8, 2019

(30) Foreign Application Priority Data

Jan. 24, 2017 (KR) ..... 10-2017-0011145

(51) Int. Cl.
*B66F 3/25* (2006.01)
*B66F 3/12* (2006.01)
*B66F 3/22* (2006.01)

(52) U.S. Cl.
CPC ..... *B66F 3/25* (2013.01); *B66F 3/12* (2013.01); *B66F 3/22* (2013.01); *B66F 2700/052* (2013.01); *B66F 2700/057* (2013.01)

(58) Field of Classification Search
CPC ..... B66F 3/08; B66F 3/12; B66F 3/22; B66F 3/247; B66F 7/06; B66F 7/0608;
(Continued)

(56) References Cited

U.S. PATENT DOCUMENTS 5,176,362 A * 1/1993 Seksaria ..... B66F 3/12 254/126
5,261,644 A * 11/1993 Armstrong ..... B66F 3/12 254/126

(Continued)

FOREIGN PATENT DOCUMENTS

CN 202766202 U 3/2013
CN 202829439 U 3/2013

(Continued)

*Primary Examiner* — Tyrone V Hall, Jr.
(74) *Attorney, Agent, or Firm* — Dentons US LLP

(57) ABSTRACT

Disclosed is a vehicle jack device. The vehicle jack device according to an exemplary embodiment of the present invention includes: a base portion in which an inserting hole into which a hinge shaft is inserted is formed and which is supported on a bottom side; a pair of lower arms of which a first portion is installed in the hinge shaft of the base portion in a rotatable way and in which a reinforcing rib is formed in a lengthwise direction; a pair of upper arms respectively installed in a second portion of the lower arm, and on which a reinforcing rib is formed in a lengthwise direction; a bracket member for fixing a first portion of the upper arm in a rotatable way; and a driver installed between (Continued)

the lower arm and the upper arm and providing a tucking driving force to the lower arm and the upper arm. Herein, multiple reinforcing ribs are formed with different heights in a lengthwise direction of the lower arm and wherein the upper arm, the base portion, the lower arm, the upper arm, and the bracket member are made of a plastic material.

12 Claims, 6 Drawing Sheets

(58) Field of Classification Search
CPC ..... B66F 7/065–0691; B66F 11/00; B66F 11/042; B66F 13/00; Y10S 254/01
See application file for complete search history.

(56) References Cited

U.S. PATENT DOCUMENTS

| | | | | |
|---|---|---|---|---|
| 5,303,898 | A | 4/1994 | Engel et al. | |
| 5,386,969 | A | 2/1995 | Popowich | |
| 5,458,316 | A | 10/1995 | Engel | |
| 9,266,704 | B1 * | 2/2016 | Hall | B66F 3/245 |
| 2008/0006801 | A1 | 1/2008 | Kikuchi | |

FOREIGN PATENT DOCUMENTS

| | | | |
|---|---|---|---|
| FR | 2534238 | A1 | 4/1984 |
| JP | 57-99891 | U | 6/1982 |
| JP | 07-186905 | A | 7/1995 |
| JP | 2579587 | B2 | 2/1997 |
| JP | 09-175283 | A | 7/1997 |
| JP | 09-175286 | A | 7/1997 |
| JP | 2005-280914 | A | 10/2005 |
| JP | 2008-013359 | A | 1/2008 |
| JP | 2009-012847 | A | 1/2009 |
| JP | 2011-116476 | A | 6/2011 |
| JP | 5323655 | B2 | 10/2013 |
| JP | 2016-132559 | A | 7/2016 |
| KR | 20-1995-0011398 | U | 5/1995 |
| KR | 10-1997-0040374 | A | 7/1997 |
| KR | 10-2007-0038937 | A | 4/2007 |
| KR | 10-2010-0021144 | A | 2/2010 |
| KR | 10-1323186 | B1 | 10/2013 |
| WO | 93/00287 | A1 | 1/1993 |

* cited by examiner

VEHICLE JACK DEVICE

This application is a National Phase entry pursuant to 35 U.S.C. § 371 of International Application No. PCT/KR2017/013211 filed on Nov. 20, 2017, and claims the benefit of priority to Korean Patent Application No. 10-2017-0011145 filed on Jan. 24, 2017, the entire disclosures of which are incorporated herein by reference.

FIELD

The present invention relates to a jack device for vehicles achieving weight reduction and durability.

BACKGROUND

In general, when a driver replaces a tire of a vehicle, he replaces the same while a jack is inserted beneath the vehicle.

That is, while a jack device is installed beneath the vehicle, a portion of the vehicle is lifted by the jack, and the tire is replaced.

The jack device, while installed below the vehicle, may receive a driving force, and may be operated to be raised or lowered, and may lift part of the vehicle.

The jack device is used when there is an emergency, and it may be stored inside the vehicle with appropriate specifications that corresponds to a weight of the vehicle.

The jack device is formed of a steel material, so it fails to sufficiently satisfy trends of weight reduction of vehicles and weight reduction of vehicle accessories.

SUMMARY

The present invention has been made in an effort to provide a vehicle jack device for allowing a reduction of weight while securing durability.

An exemplary embodiment of the present invention provides a vehicle jack device including: a base portion in which an inserting hole, into which a hinge shaft is inserted, is formed and supported on a bottom side; a pair of lower arms of which a first portion is installed in the hinge shaft of the base portion in a rotatable way and in which a reinforcing rib is formed in a lengthwise direction; a pair of upper arms respectively installed in a second portion of the lower arm, and on which a reinforcing rib is formed in a lengthwise direction; a bracket member for fixing a second portion of the upper arm in a rotatable way; and a driver installed between the lower arm and the upper arm and providing a tucking driving force to the lower arm and the upper arm.

Multiple reinforcing ribs may be formed with different heights in a lengthwise direction of the lower arm and the upper arm, and the base portion, the lower arm, the upper arm, and the bracket member may be made of a plastic material.

Regarding the lower arm, a lower inserting pipe into which the hinge shaft is inserted in a rotatable way may be formed in a first portion, and a lower inserting unit connected to the upper arm with the driver therebetween may be formed in a second portion.

The lower arm may include: a first lower arm including a first portion installed in the base portion by the lower inserting pipe in a rotatable way on the hinge shaft, a surface on which a first reinforcing rib is formed in a lengthwise direction, and a second portion in which the lower inserting unit is formed; and a second lower arm including a first portion installed in the base portion by the lower inserting pipe in a rotatable way on the hinge shaft, a surface on which a second reinforcing rib is formed in the lengthwise direction, and a second portion in which the lower inserting unit is formed.

A stopper protrusion may be protruded on a lateral side of the lower inserting pipe.

Regarding the first reinforcing rib, a first region may be formed with a same height in a direction of the lower inserting unit from the lateral side of the lower inserting pipe, and a second region may be protruded with a different height in the direction of the lower inserting unit from the first region.

Regarding the second reinforcing rib, a first region may be formed with a same height in a direction of the lower inserting unit from a lateral side of the lower inserting pipe, and a second region may be protruded with a different height in the direction of the lower inserting unit from the first region.

A first portion of an edge of the lower inserting unit may be opened in a semi-circular form.

Regarding the upper arm, an upper inserting unit connected to the lower arm with the driver therebetween may be formed in a first portion, and an upper inserting pipe into which a hinge pin installed in the bracket member is inserted may be formed in a second portion.

The upper arm may include: a first upper arm including a first portion installed in the bracket member by the upper inserting pipe in a rotatable way, a surface on which a third reinforcing rib is formed in a lengthwise direction, and a second portion in which the upper inserting unit is formed; and a second upper arm including a first portion installed in the bracket member by the upper inserting pipe in a rotatable way, a surface on which a fourth reinforcing rib is formed in a lengthwise direction, and a second portion in which the upper inserting unit is formed.

A stopper protrusion may be protruded on a lateral side of the upper inserting pipe.

Regarding the third reinforcing rib, a first region may be formed with a same height in a direction of the upper inserting unit from a lateral side of the upper inserting pipe, and a second region may be protruded with a different height in the direction of the upper inserting unit from the first region.

Regarding the fourth reinforcing rib, a first region may be formed with a same height in a direction of the upper inserting unit from a lateral side of the upper inserting pipe, and a second region may be protruded with a different height in the direction of the upper inserting unit from the first region.

A first portion of an edge of the upper inserting unit may be opened in a semi-circular form.

The driver may be a cylinder member installed between the lower arm and the upper arm.

According to an exemplary embodiment of the present invention, a configuration excluding the driver is made of a plastic material, so it is configured with replacement of the conventional steel material, thereby enabling weight reduction while acquiring durability.

According to an exemplary embodiment of the present invention, the reinforcing rib is formed on the lower arm and the upper arm of the vehicle jack device, so it is possible to secure stable durability so as to prevent generation of transformation or bending according to action of the vehicle load.

DETAILED DESCRIPTION

Figure 1:
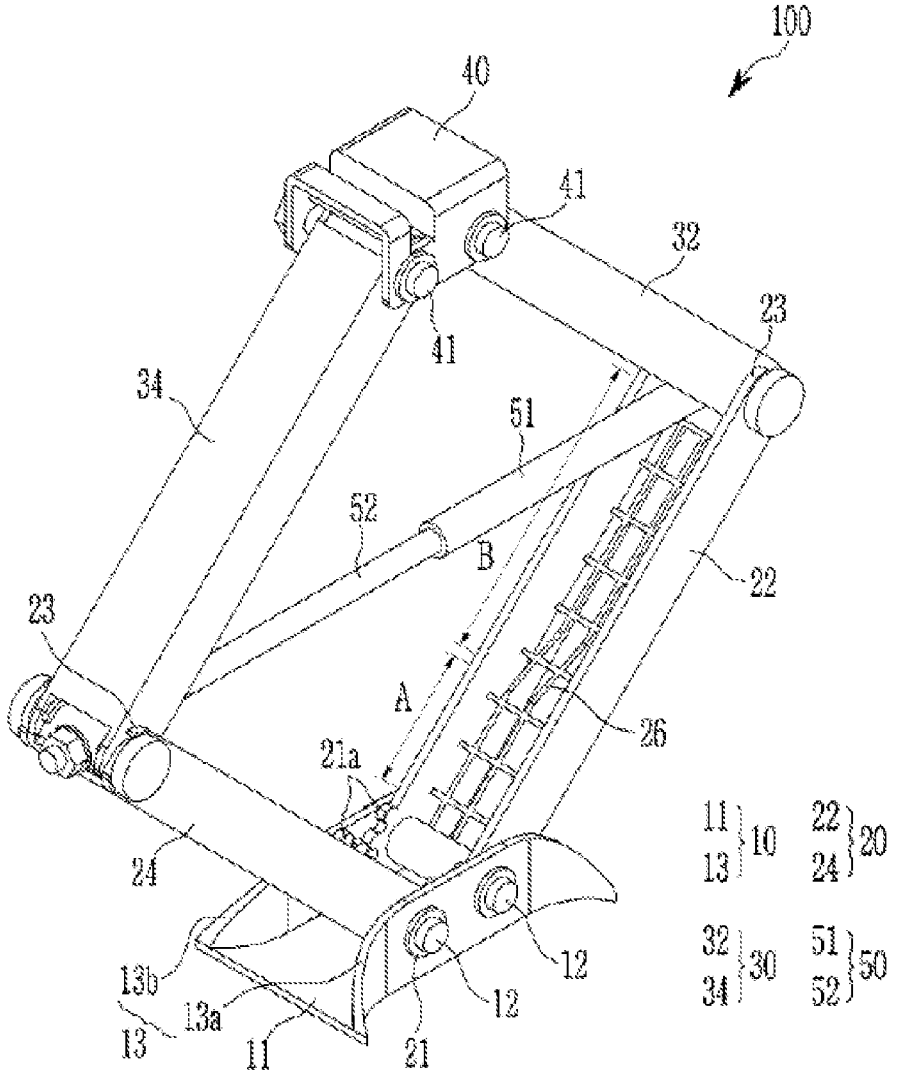
FIG. 1 shows a perspective view of a vehicle jack device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the scope of the present invention.

The drawings and description are to be regarded as illustrative in nature and not restrictive. Like reference numerals designate like elements throughout the specification.

The size and thickness of each configuration shown in the drawings are arbitrarily shown for better understanding and ease of description, and the present invention is not limited thereto.

Throughout this specification and the claims that follow, when it is described that an element is "coupled" to another element, the element may be "directly coupled" to the other element or "indirectly coupled" to the other element through a third element. Unless explicitly described to the contrary, the word "comprise" and variations such as "comprises" or "comprising" will be understood to imply the inclusion of stated elements but not the exclusion of any other elements.

Figure 2:
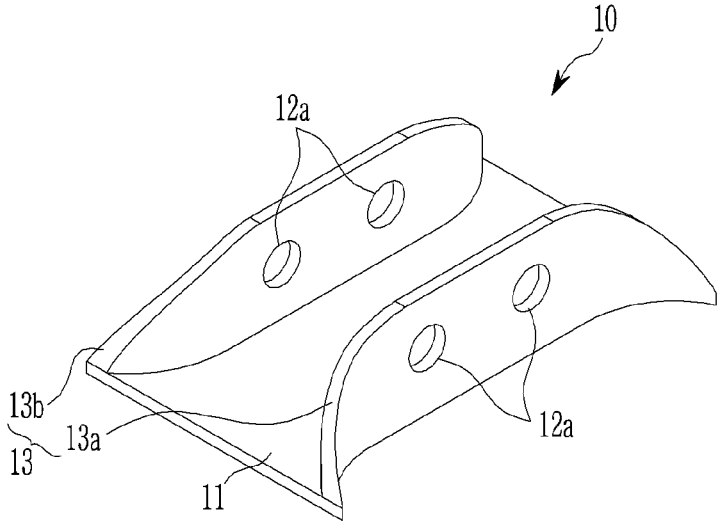
FIG. 2 shows a perspective view of a base portion of a vehicle jack device of FIG. 1.

FIG. 1 shows a perspective view of a vehicle jack device according to an exemplary embodiment of the present invention, and FIG. 2 shows a perspective view of a base portion of the vehicle jack device of FIG. 1.

As shown in FIG. 1 and FIG. 2, the vehicle jack device 100 according to an exemplary embodiment of the present invention includes: a base portion 10 in which an inserting hole 12*a* into which a hinge shaft 12 is inserted is formed and which is supported on a bottom side; a pair of lower arms 20 (22, 24) including a first portion that is installed on the hinge shaft 12 of the base portion 10 in a rotatable way and in which a reinforcing rib is formed in a lengthwise direction; a pair of upper arms 30 (32, 34) which are installed on a second portion of the lower arm 20 in a rotatable way and in which a reinforcing rib is formed in the lengthwise direction thereof; a bracket member 40 for fixing a second portion of the upper arm 30 (32, 34) in a rotatable way; and a driver 50 installed between the lower arm 20 and the upper arm 30 (32, 34) and providing a tucking driving force to the lower arm 20 and the upper arm 30 (32, 34).

The vehicle jack device 100 is formed of a plastic material. That is, the configuration of the vehicle jack device 100 according to the present exemplary embodiment except for the driver 50 is formed of a plastic material, and it may be formed with a substitute for the conventional steel material.

As described, the vehicle jack device 100 is formed of a plastic material, so its weight may be reduced. The material of the vehicle jack device 100 may be an engineering plastic material having similar rigidity to that of the steel material. The above-configured vehicle jack device 100 will now be described in detail.

As shown in FIG. 2, the base portion 10 includes a lower side supported on a bottom side of an installation place, and it may be installed to stably support a load of the vehicle.

In detail, the base portion 10 may include a lower side unit 11 supported on a bottom side, and a lateral side unit 13 that is bent in an upper direction on respective sides of an edge of the lower side unit 11.

The lower side unit 11 may be formed so that an installation area may increase in a lengthwise direction while its lower side contacts the bottom side of the installation place.

That is, the lower side unit 11 may be formed so that it may have an area that gradually increases in respective directions away from a center portion in the lengthwise direction of the lower side unit 11, and a first portion in the lengthwise direction and a corresponding second portion may accordingly have a maximized area.

The lateral side unit 13 may be formed to be bent on an edge of the lower side unit 11.

The lateral side unit 13 may include a first lateral side 13*a* formed to be bent on a first portion of the edge of the lower side unit 11, and a second lateral side 13*b* formed to be bent on a second portion of the edge of the lower side unit 11 at a position facing the first lateral side 13*a*.

The first lateral side 13*a* and the second lateral side 13*b* may be formed with the same shape to face each other, and may be formed to be bent at the edge of the lower side unit 11. The one or more hinge holes 12*a* are formed in the first lateral side 13*a* and the second lateral side 13*b* to accommodate the hinge shaft 12. Two hinge shafts 12 may be installed between the first lateral side 13*a* and the second lateral side 13*b*. The lower arm 20 is installed on the hinge shaft 12 in a rotatable way.

Figure 3:
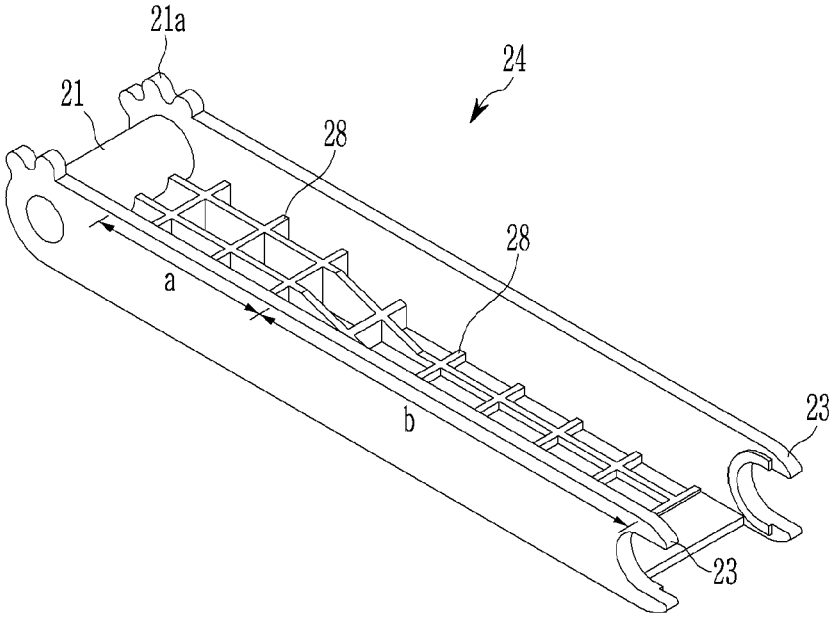
FIG. 3 shows a perspective view of a lower arm of a vehicle jack device of FIG. 1.

FIG. 3 shows a perspective view of a lower arm of a vehicle jack device of FIG. 1.

As shown in FIG. 1 and FIG. 3, lower arm 20 includes a first portion in which a lower inserting pipe 21 into which the hinge shaft 12 is inserted in a rotatable way is formed, and a second portion in the form of lower inserting unit 23 that is connected to the upper arm 30 with the driver 50 therebetween may be formed in the lower arm 20.

In detail, the lower arm 20 may include a first lower arm 22 including a first portion installed in the base portion 10 by the lower inserting pipe 21 to be rotated at the hinge shaft 12, and a second lower arm 24 including a first portion installed in the base portion 10 by the lower inserting pipe 21 to be rotated at the hinge shaft 12 while separated from the first lower arm 22.

The lower inserting pipe 21 may be formed on the first portion of the first lower arm 22 in a direction crossing the lengthwise direction of the first lower arm 22.

The lower inserting pipe 21 is formed to be cylindrical, and the hinge shaft 12 is inserted into an internal portion of the lengthwise direction. A stopper protrusion 21*a* may be formed on a lateral side of the lower inserting pipe 21.

A plurality of stopper protrusions 21*a* are protruded at a part of the lateral side of the lower inserting pipe 21, thereby preventing the first lower arm 22 from excessively rotating to a first portion.

The lower inserting unit 23 may be formed on the first lower arm 22 at a position opposite to the lower insertion pipe 21. The lower inserting unit 23 may be formed with a first portion having an edge with an opening, on a second portion of the first lower arm 22.

As described, the lower inserting unit 23 is formed on the first lower arm 22 so that it may not be separated during a process of assembling the vehicle jack device 100 according to the present exemplary embodiment. That is, the lower inserting unit 23 is a portion that is connected so that the second lower arm 24 may be rotated with the driver 50 therebetween, and a portion of the driver 50 may be inserted into the same and may be fixed. Therefore, it is hooked and fixed through the open portion of the edge of the lower inserting unit 23, thereby preventing separation from the assembled state. The lower inserting unit 23 replaces the conventional closed circular form and its first portion is opened in a semi-circular form, so a connection portion may be easily controlled during an assembling process.

The second lower arm 24, while separated from the first lower arm 22 by a predetermined distance, may be installed in the hinge shaft 12 installed in the base portion 10 in a rotatable way.

The lower inserting pipe 21 may be formed in the first portion of the second lower arm 24, and the lower inserting unit 23 may be formed in the second portion. Here, the lower inserting pipe 21 and the lower inserting unit 23 of the second lower arm 24 are the same as or similar to the lower inserting pipe 21 and the lower inserting unit 23 formed to the first lower arm 22.

A plurality of stopper protrusions 21*a* are protruded on the lateral side of the lower inserting pipe 21 formed in the second lower arm 24, thereby preventing the second lower arm 24 from being excessively rotated toward the first portion.

In addition, a first reinforcing rib 26 and a second reinforcing rib 28 are formed on the first lower arm 22 and the second lower arm 24, respectively.

The first reinforcing rib 26 may be formed to be protruded on a surface in the lengthwise direction of the first lower arm 22. The above-noted first reinforcing rib 26 may prevent the first lower arm 22 from being transformed such as being curved or bent when a load of a vehicle is transmitted thereto.

The first reinforcing rib 26 may be formed with a different protruding height in the direction of the lower inserting unit 23 from the lateral side of the lower inserting pipe 21.

That is, regarding the first reinforcing rib 26, a first region (A) with a predetermined length in the direction of the lower inserting unit 23 from the lateral side of the lower inserting pipe 21 may be formed to have a constant height.

Regarding the first reinforcing rib 26, a second region (B) with a predetermined length in the direction of the lower inserting unit 23 from the first region (A) may be formed to have a height that is less than the height of the first region (A).

As described, the first reinforcing rib 26 is formed in the lengthwise direction with the different heights of the first region (A) and the second region (B) so that durability may be further reinforced near the first region (A) that is a position near where the lower inserting pipe 21 is formed to stably support the vehicle load, and generation of interference among parts such as an upper arm and a lower arm may be prevented when the vehicle jack device is used at a lowest point.

The second reinforcing rib 28 may be formed to be protruded on the surface in the lengthwise direction of the second lower arm 24.

The second reinforcing rib 28 may prevent the second lower arm 24 from being transformed such as being curved or bent when a load of a vehicle is transmitted thereto.

The second reinforcing rib 28 may be formed with a different protruding height in the direction of the lower inserting unit 23 from the lateral side of the lower inserting pipe 21.

That is, regarding the second reinforcing rib 28, a first region (a) with a predetermined length in the direction of the lower inserting unit 23 from the lateral side of the lower inserting pipe 21 may be formed to have a constant height.

Regarding the second reinforcing rib 28, a second region (b) with a predetermined length in the direction of the lower inserting unit 23 from the first region (a) may be formed to have a height that is less than the height of the first region (a).

As described, the second reinforcing rib 28 is formed in the lengthwise direction with the different heights of the first region (a) and the second region (b) so as to increase the durability in the first region (a) that is a position near where the lower inserting pipe 21 is formed and stably support the vehicle load.

As described above, the first reinforcing rib 26 and the second reinforcing rib 28 are formed in the lengthwise direction of the first lower arm 22 and the second lower arm 24, thereby securing stable durability during the operation of supporting the vehicle load.

The upper arm 30 is installed in an upper portion of the lower arm 20.

Figure 4:
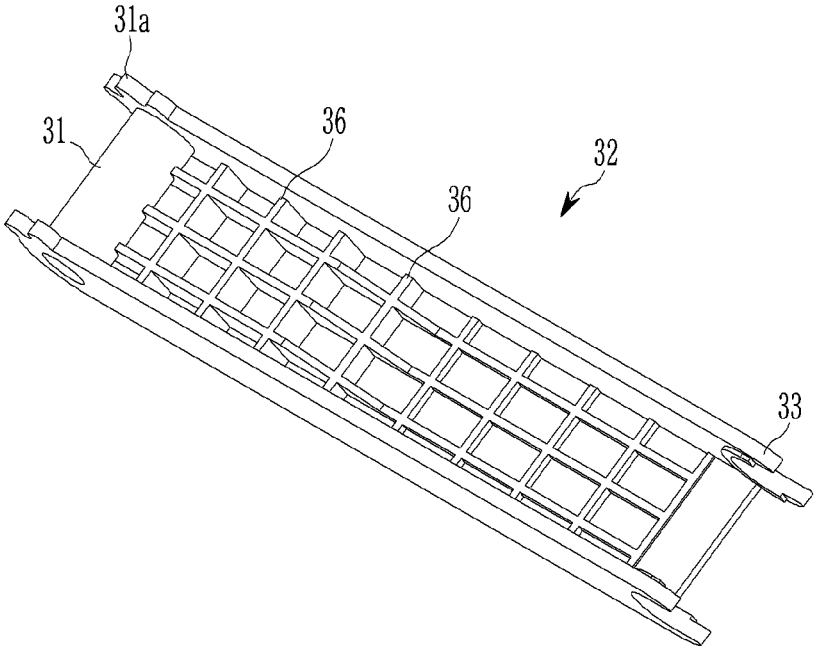
FIG. 4 shows a perspective view of a first upper arm of FIG. 1.
Figure 5:
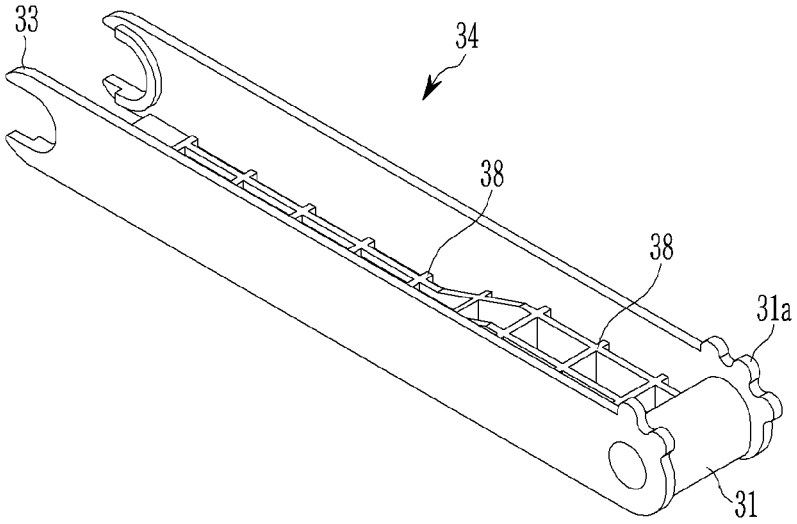
FIG. 5 shows a perspective view of a second upper arm of FIG. 1.

FIG. 4 shows a perspective view of a first upper arm 32 of FIG. 1, and FIG. 5 shows a perspective view of a second upper arm 34 of FIG. 1.

As shown in FIG. 4 and FIG. 5, regarding the upper arm 30 (32, 34), an upper inserting unit 33 connected to the lower arm 20 with the driver 50 provided therebetween may be formed on a first portion, and an upper inserting pipe 31 into which a hinge pin installed in a bracket member 40 is inserted may be formed on a second portion.

The upper arm 30 may include a first upper arm 32 including a first portion in which the upper inserting unit 33 is formed, and a second portion installed in the bracket member 40 by the upper inserting pipe 31 in a rotatable way, and a second upper arm 34 including a first portion in which the upper inserting unit 33 is formed, and a second portion installed in the bracket member 40 by the upper inserting pipe 31 in a rotatable way.

The upper inserting unit 33 replaces the conventional closed circular form and its first portion is opened in a semi-circular form, so a connection portion may be easily controlled during an assembling process.

Regarding the first upper arm 32, as described above, a second portion may be connected to the bracket member 40 in a rotatable way, and a first portion may be installed in the first lower arm 22 in a rotatable way with the driver 50 therebetween.

Further, regarding the second upper arm 34, a second portion may be connected to the bracket member 40 in a rotatable way, and a first portion may be installed in the second lower arm 24 in a rotatable way with the driver 50 therebetween.

A stopper protrusion 31*a* may be formed on a lateral side of the upper inserting pipe 31 formed in the first upper arm 32 and the second upper arm 34.

A plurality of stopper protrusions 31*a* are protruded on a part of the lateral side of the upper inserting pipe 31, thereby preventing the first upper arm 32 and the second upper arm 34 from excessively rotating to a first portion.

A third reinforcing rib 36 and a fourth reinforcing rib 38 may be respectively formed on the first upper arm 32 and the second upper arm 34, respectively, of the upper arm 30.

The respective third reinforcing rib 36 and fourth reinforcing rib 38 are formed in the lengthwise direction of the first upper arm 32 and the second upper arm 34, and they may be respectively formed with a same shape as or a similar shape to the first reinforcing rib 26 and the second reinforcing rib 28.

The respective third reinforcing rib 36 and fourth reinforcing rib 38 are formed with different heights in the direction from the upper inserting unit 33 to the upper inserting pipe 31, which has been described in detail with reference to the above-described first reinforcing rib 26 and the second reinforcing rib 28 and repeated description thereof will be omitted herein.

Figure 6:
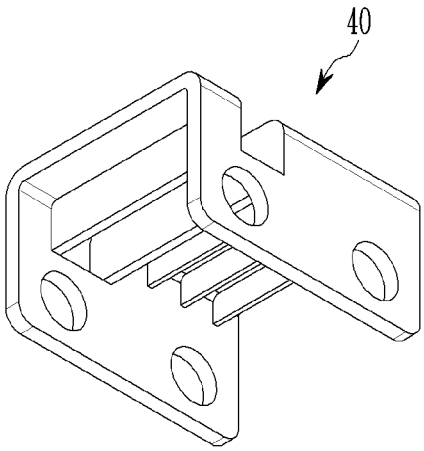
FIG. 6 shows a perspective view of a bracket member according to an exemplary embodiment of the present invention.

FIG. 6 shows a perspective view of a bracket member according to an exemplary embodiment of the present invention.

As shown in FIG. 1 and FIG. 6, regarding the bracket member 40, respective second portions of the first upper arm 32 and the second upper arm 34 may be connected to be rotatable by a hinge shaft 41.

As described, the lower arm 20 and the upper arm 30 receive a driving force of the driver 50 between the base portion 10 and the bracket member 40 and are installed to be tucked therebetween, thereby fluently performing the vehicle raising task.

In addition, the driver 50 may be provided with a piston-cylinder device between the lower arm 20 and the upper arm 30. That is, the driver 50 may include a cylinder 51 connected to the first lower arm 22 and the first upper arm 32, and a piston 52 connected to the second lower arm 24 and the second upper arm 34. Therefore, the vehicle jack device 100 may lift or lower the vehicle as the piston 52 moves forward or backward with respect to the cylinder 51.

As described above, regarding the vehicle jack device 100 according to the present exemplary embodiment, the configuration except for the driver 50 is formed of a plastic material, so conventional steel material is replaced to allow for a reduction in weight of the jack device 100.

Further, reinforcing ribs are formed on the lower arm 20 and the upper arm 30 of the vehicle jack device 100, so it is possible to achieve stability and durability, preventing deformation or bending by the reaction of the vehicle load.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

The invention claimed is:

1. A vehicle jack device comprising:

a base portion comprising an inserting hole into which a hinge shaft is inserted, and which is supported on a bottom side;

a pair of lower arms, each comprising a first portion receiving the hinge shaft of the base portion therein in a rotatable way, and further comprising a lower arm reinforcing rib disposed in a lengthwise direction thereon;

a pair of upper arms, each respectively installed in a second portion of the lower arms, and comprising a upper arm reinforcing rib is disposed in a lengthwise direction thereon;

a bracket member for fixing a second portion of the upper arms in a rotatable way; and a driver installed between the lower arms and the upper arms configured to provide a tucking driving force to the lower arms and the upper arms, wherein multiple lower arm and upper arm reinforcing ribs are formed with different heights in a lengthwise direction of the lower arms and the upper arms, wherein the base portion, the lower arm, the upper arm, and the bracket member are made of a plastic material, wherein the first portion of the pair of lower arms comprises a lower inserting pipe formed on the first portion of the lower arms and extending across the lengthwise direction of the lower arms into which the hinge shaft is inserted in a rotatable way, and the second portion of the pair of lower arms comprises a lower inserting unit connected to the upper arm with the driver therebetween, and wherein a first portion of an edge of the lower inserting unit is opened in a semicircular form.

2. The vehicle jack device of claim 1, wherein the pair of lower arms comprise:

a first lower arm including a first portion installed in the base portion by the lower inserting pipe in a rotatable way on the hinge shaft, a surface on which a first lower arm reinforcing rib is formed in a lengthwise direction, and a second portion in which the lower inserting unit is formed; and a second lower arm including a first portion installed in the base portion by the lower inserting pipe in a rotatable way on the hinge shaft, a surface on which a second lower arm reinforcing rib is formed in the lengthwise direction, and a second portion in which the lower inserting unit is formed.

3. The vehicle jack device of claim 2, wherein, a first region along the lengthwise direction of the first lower arm wherein the first lower arm reinforcing rib has a first height, and a second region along the lengthwise direction of the first lower arm wherein the first lower arm reinforcing rib has a second height that is different from the first height.

4. The vehicle jack device of claim 2, wherein, a first region along the lengthwise direction of the second lower arm wherein the second lower arm reinforcing rib has a first height, and a second region along the lengthwise direction of the second lower arm wherein the second lower arm reinforcing rib has a second height that is different from the first height.

5. The vehicle jack device of claim 1, wherein the first portion of the pair of lower arms comprises a stopper protrusion on a lateral side of the lower inserting pipe.

6. The vehicle jack device of claim 1, wherein, the first portion of the pair of upper arms comprises an upper inserting unit connected to the lower arm with the driver therebetween, and the second portion of the pair of upper arms comprises an upper inserting pipe into which a hinge pin is installed in the bracket member.

7. The vehicle jack device of claim 6, wherein the pair of upper arms comprise:

a first upper arm including a first portion in which the upper inserting unit is formed, a surface on which a third upper arm reinforcing rib is formed in a lengthwise direction, and a second portion installed in the bracket member by the upper inserting pipe in a rotatable way; and a second upper arm including a first portion in which the upper inserting unit is formed, a surface on which a fourth upper arm reinforcing rib is formed in a lengthwise direction, and a second portion installed in the bracket member by the upper inserting pipe in a rotatable way.

8. The vehicle jack device of claim 7, wherein, the third upper arm reinforcing rib comprises a first region along the lengthwise direction of the first upper arm wherein the rib has a first height, and a second region along the lengthwise direction of first upper arm wherein the third upper arm reinforcing rib has a second height that is different than the first height.

9. The vehicle jack device of claim 7, wherein, a first region along the lengthwise direction of the second upper arm wherein the fourth upper arm reinforcing rib has a first height, and a second region along the lengthwise direction of the second upper arm wherein the fourth upper arm reinforcing rib has a second height that is different than the first height.

10. The vehicle jack device of claim 7, wherein a first portion of an edge of the upper inserting unit is opened in a semi-circular form.

11. The vehicle jack device of claim 6, wherein

The second portion of the pair of upper arms comprises a stopper protrusion on a lateral side of the upper inserting pipe.

12. The vehicle jack device of claim 1, wherein the driver is a piston-cylinder device installed between the lower arms and the upper arms.

* * * * *